US007726293B2

(12) United States Patent
Wei

(10) Patent No.: US 7,726,293 B2
(45) Date of Patent: Jun. 1, 2010

(54) CONTINUOUS FIRING TYPE TRIGGER STRUCTURE FOR TOY GUN

(76) Inventor: Wilson Wei, P.O. Box 24-108, Taipei (TW)

( * ) Notice: Subject to any disclaimer, the term of this patent is extended or adjusted under 35 U.S.C. 154(b) by 0 days.

(21) Appl. No.: 12/151,444

(22) Filed: May 8, 2008

(65) Prior Publication Data

US 2009/0277436 A1 Nov. 12, 2009

(51) Int. Cl.
*F41B 11/00* (2006.01)

(52) U.S. Cl. ..... 124/74; 124/73; 124/76

(58) Field of Classification Search ..... 124/70–74, 124/76

See application file for complete search history.

(56) References Cited

U.S. PATENT DOCUMENTS

| | | | | |
|---|---|---|---|---|
| 3,204,625 | A * | 9/1965 | Shepherd | 124/74 |
| 4,147,152 | A * | 4/1979 | Fischer et al. | 124/76 |
| 5,476,087 | A * | 12/1995 | Kunimoto | 124/73 |
| 5,509,399 | A * | 4/1996 | Poor | 124/76 |
| 5,711,286 | A * | 1/1998 | Petrosyan et al. | 124/73 |
| 6,026,797 | A * | 2/2000 | Maeda et al. | 124/74 |
| 6,494,194 | B2 * | 12/2002 | Shipachev et al. | 124/73 |
| RE39,805 | E * | 9/2007 | Maeda et al. | 124/74 |
| 7,273,047 | B2 * | 9/2007 | Hu | 124/74 |
| 7,353,816 | B2 * | 4/2008 | Maeda et al. | 124/73 |
| 2007/0181116 | A1 * | 8/2007 | Wei | 124/74 |

* cited by examiner

*Primary Examiner*—Troy Chambers
*Assistant Examiner*—Gabriel J Klein
(74) *Attorney, Agent, or Firm*—Jackson IPG PLLC

(57) ABSTRACT

A continuous firing type trigger structure of a toy gun (air soft gun/BB-gun) includes a valve body disposed behind the output port of a magazine clip in air communication with the gas outlet of a high-pressure gas can, an enclosed socket connected to the rear side of the valve body, a valve tube inserted through the valve body, a spring that pushes the valve tube forwards to keep the air inlet of the valve tube not in communication with the inside space of the valve body, and a piston inserted into the enclosed socket and fixedly connected to a sliding shell on the outside of the toy gun such that the valve tube is moved with the piston forwards (or backwards) to let a high pressure gas be discharged out of the high-pressure gas can into the valve tube to drive an airsoft gun out of the toy gun and to force the piston and the sliding shell backwards after triggering of the trigger of the toy gun, for enabling the piston and the sliding shell to be immediately returned by a return spring for a next firing operation. A hammer is pivoted to the toy gun and releasably secured in place by a spring-supported sear for firing one single airsoft bullet per each hammering action.

1 Claim, 9 Drawing Sheets

CONTINUOUS FIRING TYPE TRIGGER STRUCTURE FOR TOY GUN

BACKGROUND OF THE INVENTION

1. Field of the Invention

The present invention relates to a toy gun (air soft gun/BB-gun) and more particularly, to a continuous firing type trigger structure for toy gun (air soft gun/BB-gun).

2. Description of the Related Art

An air soft gun/BB-gun is a tool for training of shooting techniques or playing of a shooting game. An air soft gun/BB-gun utilizes a high pressure gas to drive airsoft bullets out of the gun barrel, i.e., an air soft gun/BB-gun comprises an accommodation chamber accommodating a high-pressure gas can and a valve tube for guiding out discharged high pressure gas from the high-pressure gas can to drive an airsoft bullet out of the gun barrel. However, the user must pull the firing mechanism to the initial position manually after firing of one airsoft bullet so that the air soft gun/BB-gun can be operated to fire another airsoft bullet again. This single firing mode toy gun is less attractive to most people. Therefore, continuous firing mode trigger structures are created. However, because these continuous firing mode trigger structures are commonly formed of a big number of parts, their fabrication requires much time and labor, increasing the manufacturing cost. Further, the common back sliding action of the gun barrel to cause a bullet firing action according to the continuous firing mode trigger structures does not simulate the firing operation of a real gun.

SUMMARY OF THE INVENTION

The present invention has been accomplished under the circumstances in view. It is the main object of the present invention to provide a continuous firing type trigger structure for toy gun (air soft gun/BB-gun), which eliminates the drawbacks of the aforesaid prior art designs.

According to one embodiment of the present invention, the continuous firing more trigger structure mechanism is used in a toy gun and controllable by a trigger of the toy gun to drive airsoft bullets out of a sliding gun barrel of the toy gun, comprising a valve body, an enclosed socket, a piston, a hammer and a sliding shell, wherein the valve body is disposed behind an output port of a magazine clip being mounted in the toy gun in air communication with an air outlet nozzle of a high-pressure gas can being mounted in the toy gun, the valve body comprising a rear end axially connected with the enclosed socket, an axial through hole extending through front and rear ends thereof, a gas outlet valve tube inserted through the axial through hole of the valve body movable backwards by the sliding gun barrel of the toy gun, the gas outlet valve tube having an air inlet and an air passage, and a spring mounted therein to support the gas outlet valve tube in a position where the air inlet of the gas outlet valve tube is isolated from the inside space of the valve body; the piston is affixed to the sliding shell, which is slidably mounted on the toy gun, and inserted into the enclosed socket.

According to another embodiment of the present invention, the continuous firing more trigger structure mechanism is used in a toy gun and controllable by a trigger of the toy gun to drive airsoft bullets out of a sliding gun barrel of the toy gun, comprising a valve body, an enclosed socket, a piston, a hammer and a sliding shell, wherein the valve body is disposed behind an output port of a magazine clip being mounted in the toy gun in air communication with an air outlet nozzle of a high-pressure gas can being mounted in the toy gun, the valve body comprising a rear end axially connected with the enclosed socket, an axial through hole extending through front and rear ends thereof, a gas outlet valve tube inserted through the axial through hole of the valve body movable forwards relative to the valve body, the gas outlet valve tube having an air inlet and an air passage, and a spring mounted therein to support the gas outlet valve tube in a position where the air inlet of the gas outlet valve tube is isolated from the inside space of the valve body; the piston is affixed to the sliding shell, which is slidably mounted on the toy gun, and inserted into the enclosed socket, having a pin axially disposed at the center, the pin having a front end stopped against one end of the gas outlet valve tube and a rear end facing and strikable by a face of a hammer being pivoted to the toy gun, the hammer having a retaining flange releasably engaged by a spring-supported sear at the toy gun.

DETAILED DESCRIPTION OF THE PREFERRED EMBODIMENT

Figure 5:
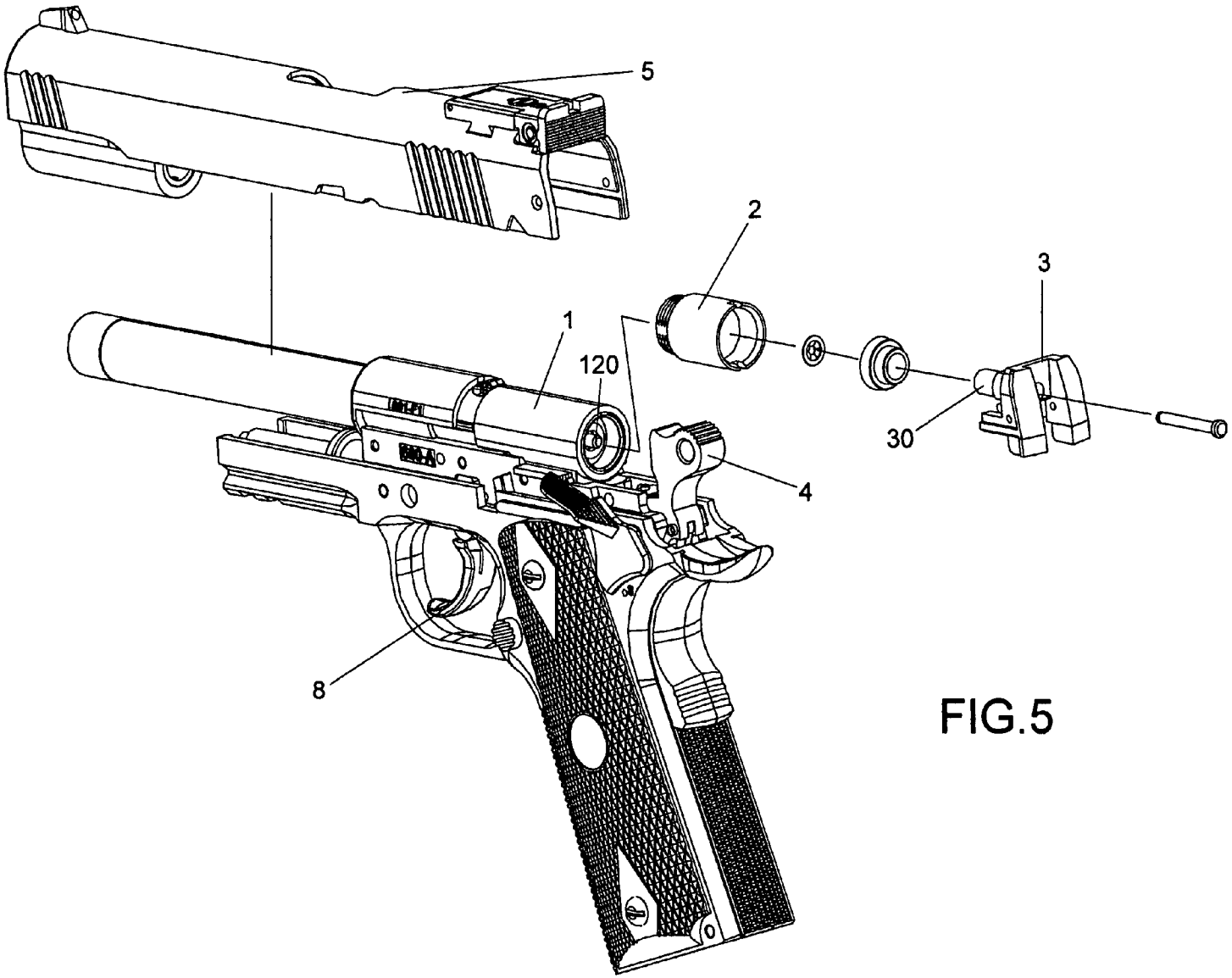
FIG. 5 is an exploded view of a continuous firing type trigger structure in accordance with a second embodiment of the present invention.
Figure 6:
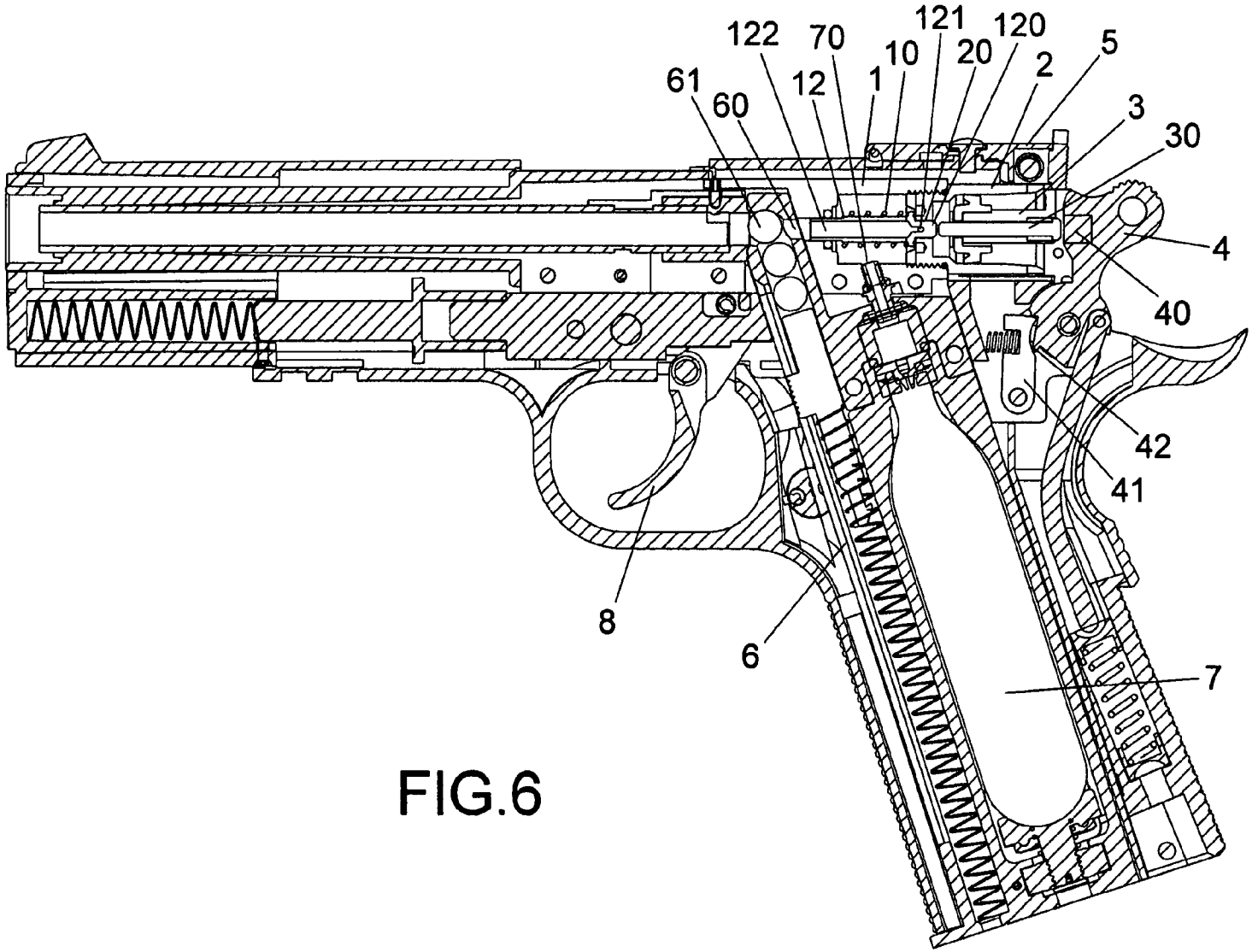
FIG. 6 is a sectional side view of the second embodiment of the present invention before operation of the hammer of the continuous firing type trigger structure.
Figure 7:
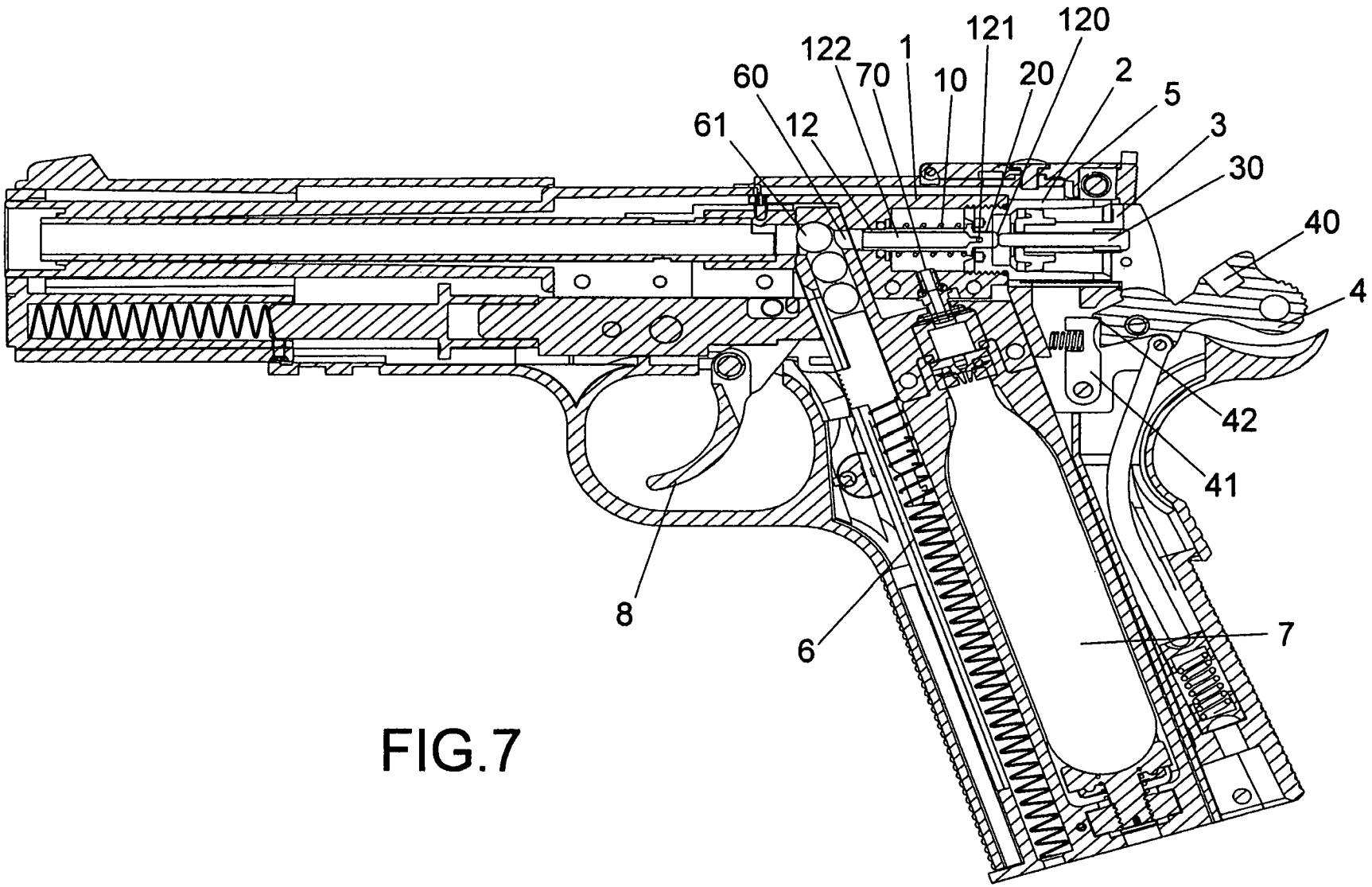
FIG. 7 corresponds to FIG. 6, showing the hammer set in the released position.
Figure 8:
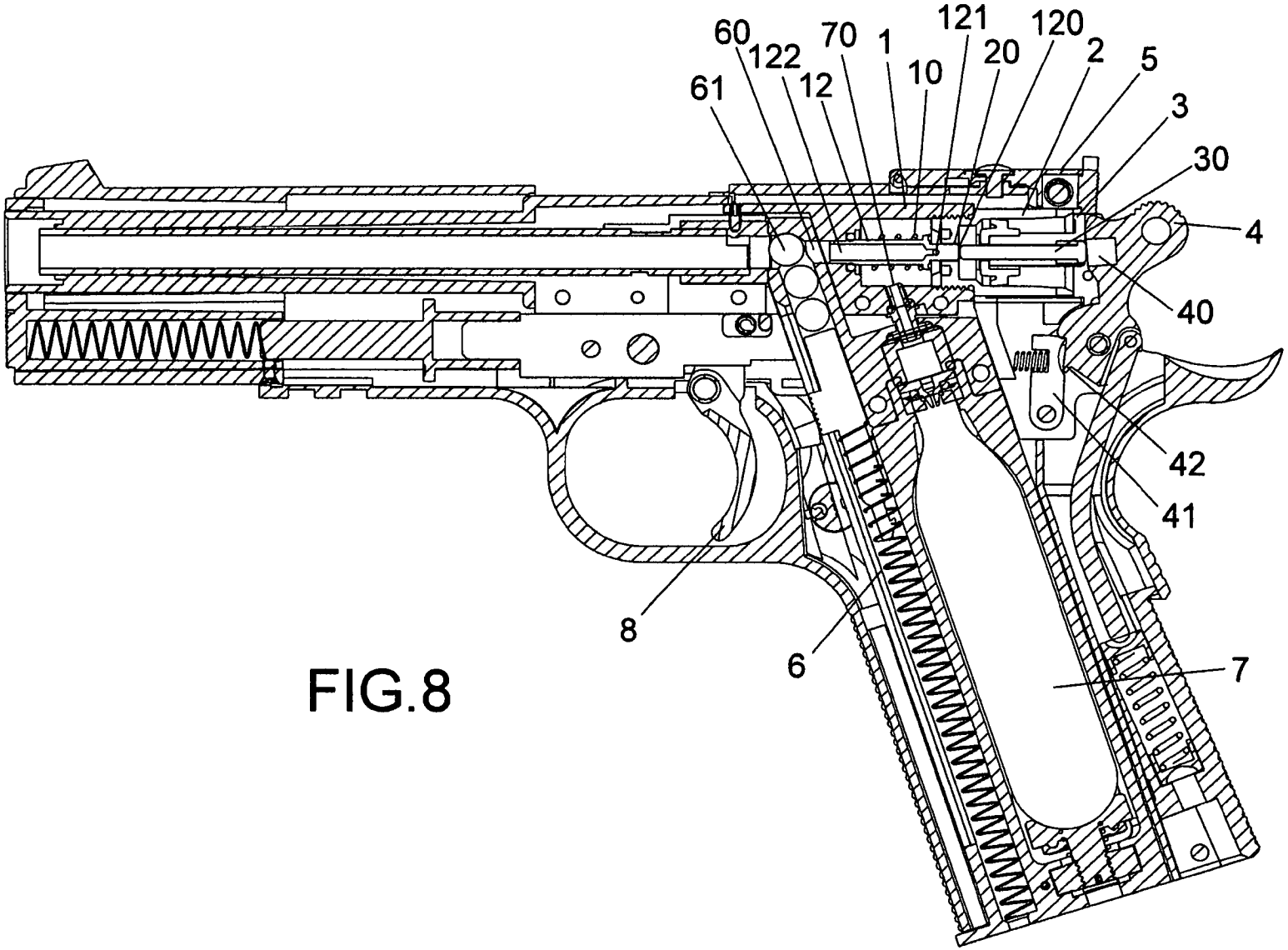
FIG. 8 corresponds to FIG. 7, showing the hammer strike the rear end of the pin of the piston.
Figure 9:
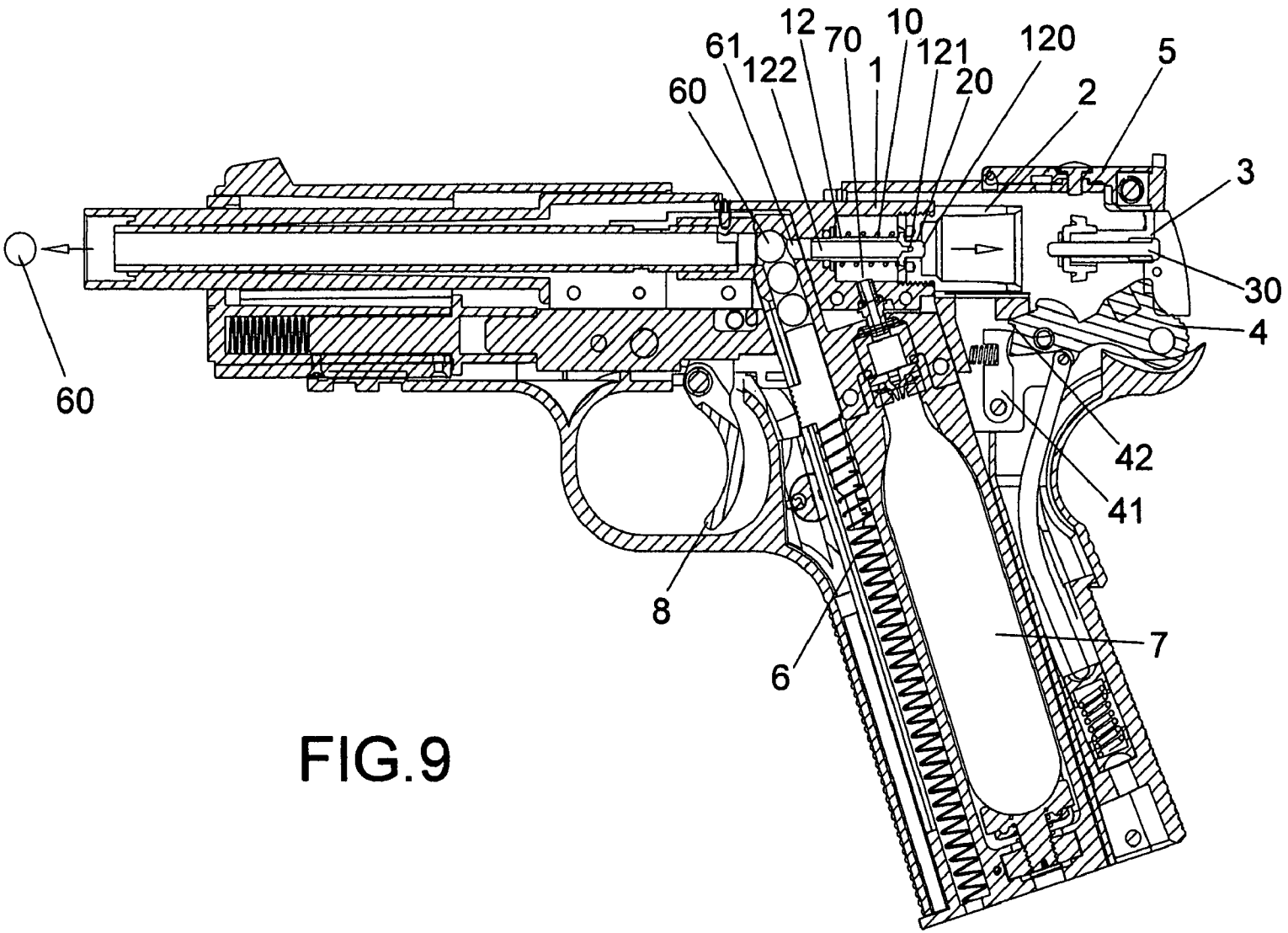
FIG. 9 corresponds to FIG. 8, showing the piston returned to the former position after firing of one bullet.

Referring to the annexed drawings in detail, a continuous firing type trigger structure in accordance with the present invention is shown used in a toy gun (air soft gun/BB-gun), comprising a valve body 1, an enclosed socket 2, a piston 3, a hammer 4, and a sliding shell 5. The valve body 1 is disposed behind the output port 60 of a magazine clip (bullet feeder) 6 in air communication with the air outlet nozzle 70 of a high-pressure gas can 7. The enclosed socket 2 is axially connected to the rear end of the valve body 1. A gas outlet valve tube 12 is inserted through an axial through hole 20 that extends through the front and rear sides of the valve body 1, and supported on a spring 10. The gas outlet valve tube 12 has an air passage 122 and an air inlet 121 at one end of the air passage 122. The spring 10 imparts a pressure to the gas outlet valve tube 12, holding the gas outlet valve tube 12 in a position where the air inlet 121 is isolated from the inside space of the valve body 1. The piston 3 is affixed to the sliding shell 5 and inserted into the enclosed socket 2. As shown in FIGS. 5~10, the piston 3 has a pin 30 axially disposed at the center. The pin 30 has a front end is stopped against the one end 120 of the gas outlet valve tube 12, and a rear end facing the face 40 of the hammer 4. The hammer 4 has a retaining flange 42 releasably engaged by a spring-supported sear 41, and can be driven to strike the rear end of the pin 30.

Figure 1:
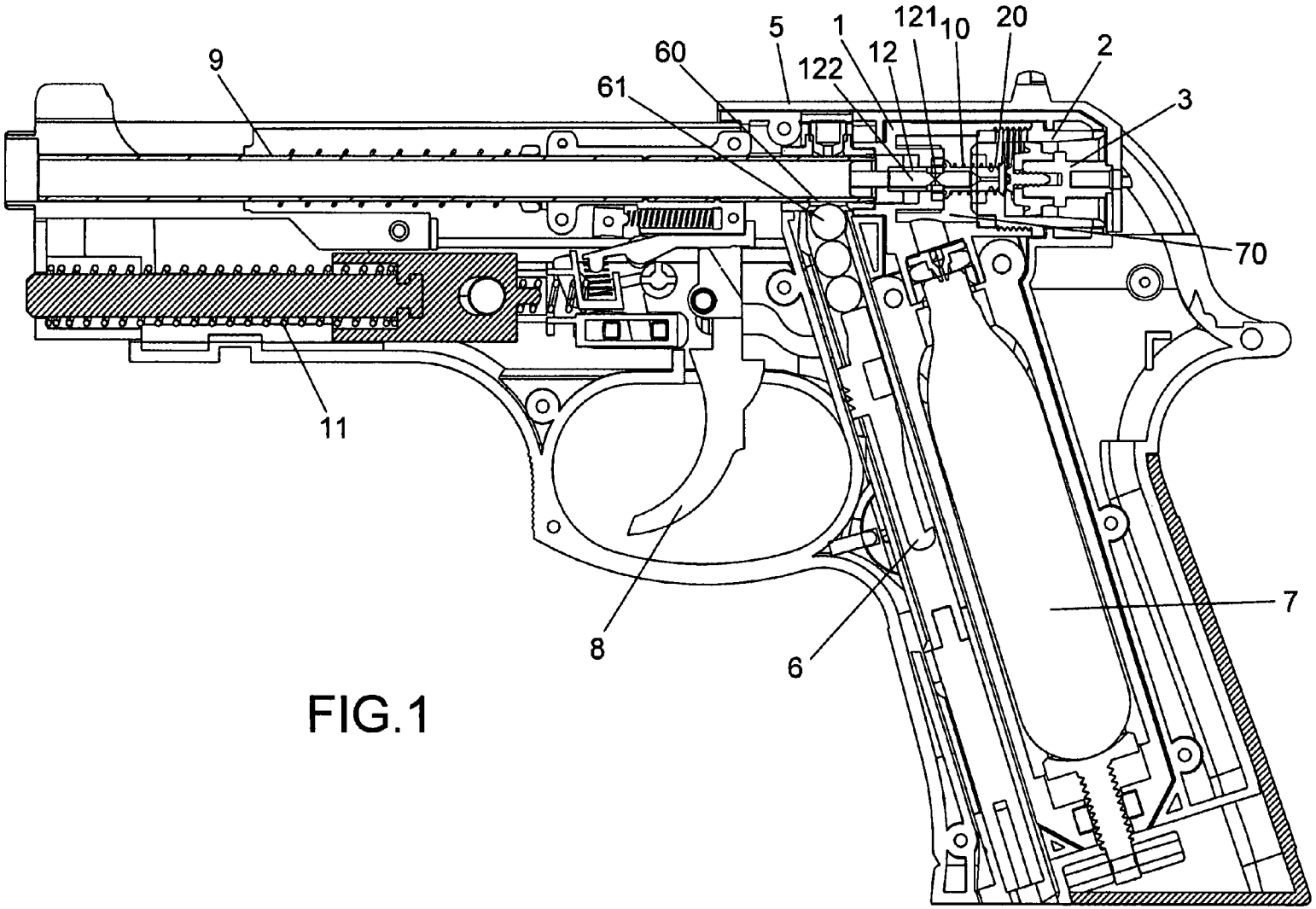
FIG. 1 is a sectional side view, showing a continuous firing type trigger structure used in a toy gun in accordance with a first embodiment of the present invention.
Figure 2:
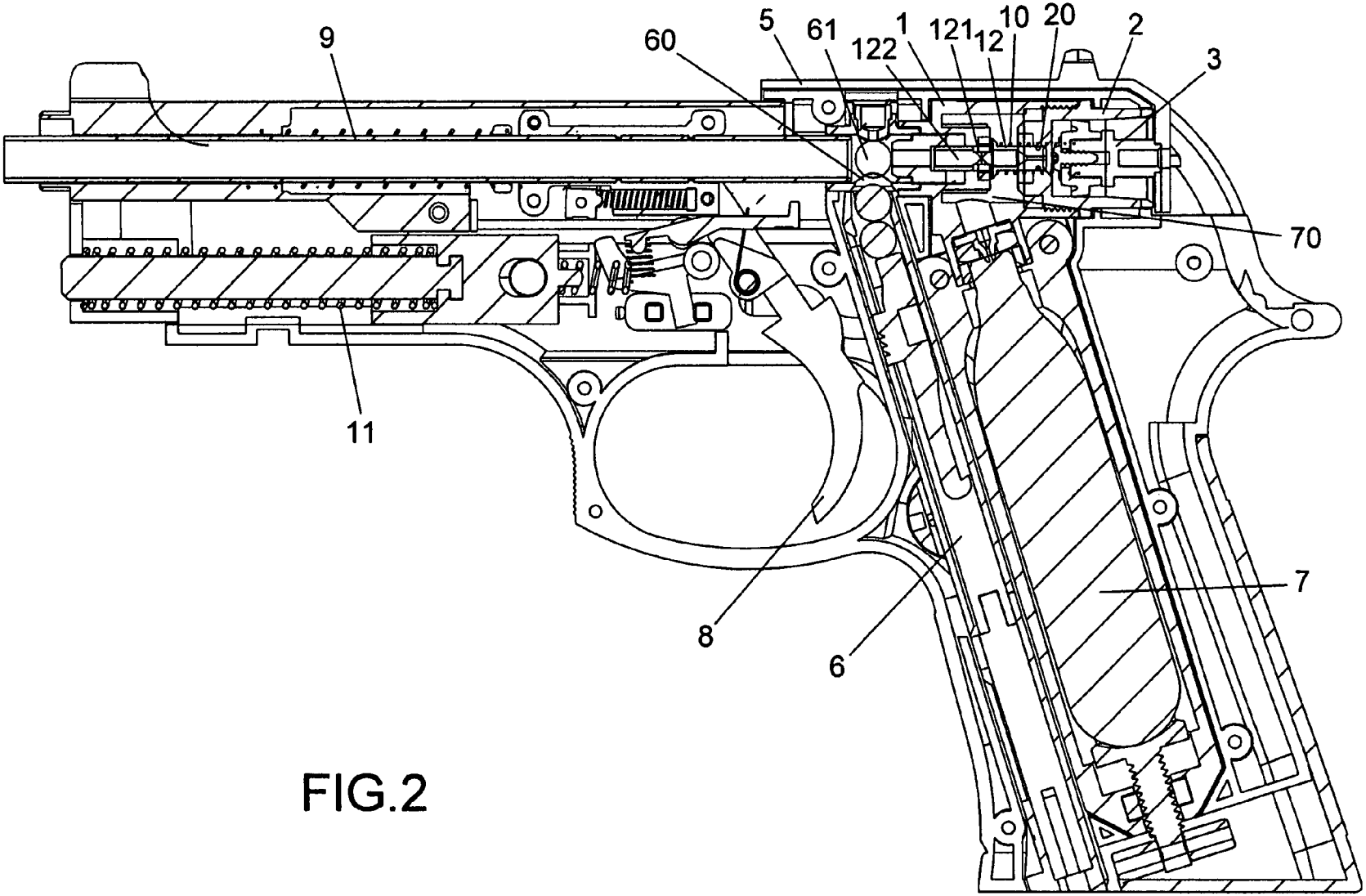
FIG. 2 is a sectional side view of the first embodiment of the present invention, showing the trigger pressed.
Figure 3:
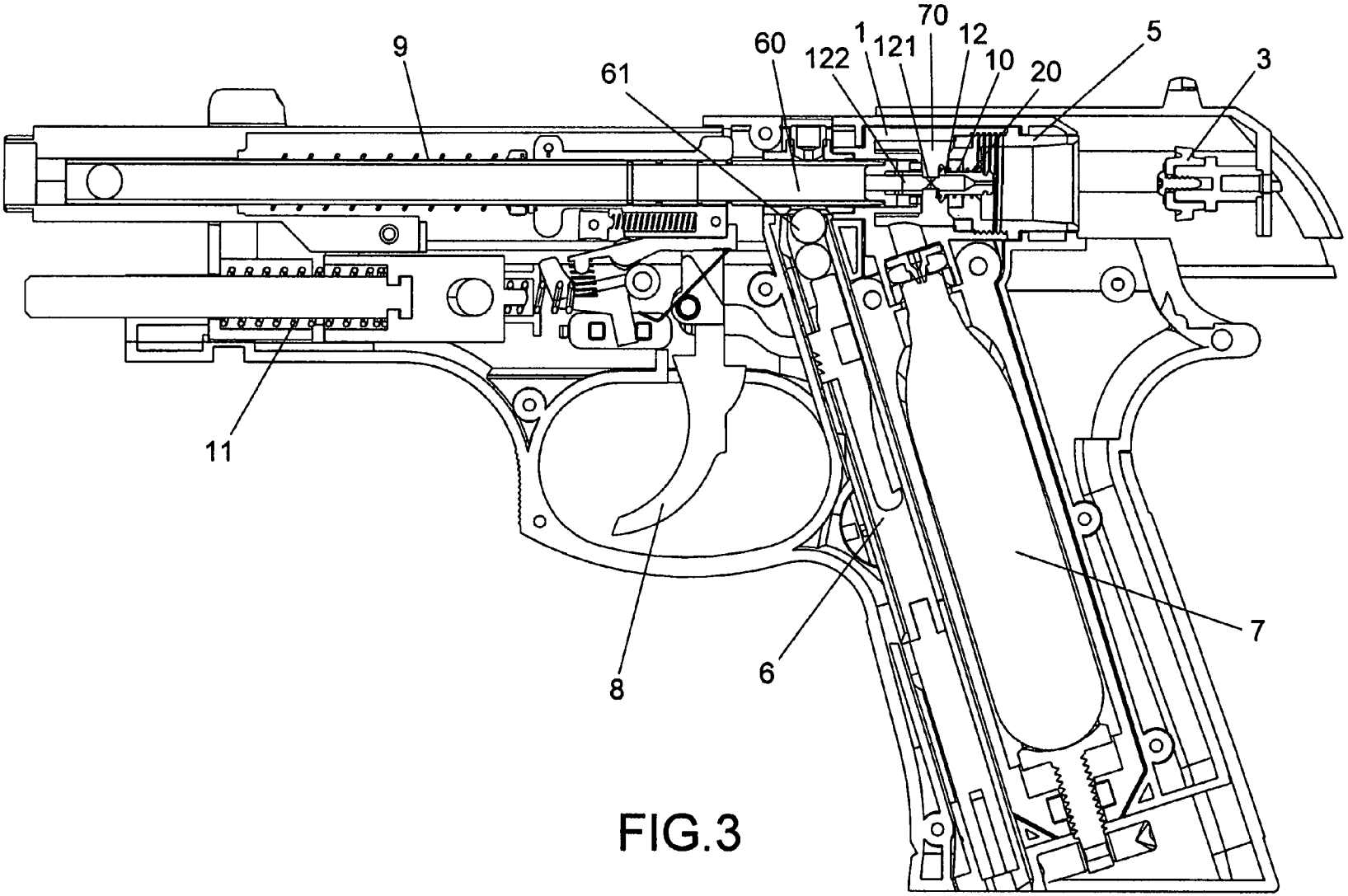
FIG. 3 is a sectional side view of the first embodiment of the present invention of the present invention, showing a bullet firing action of the toy gun.
Figure 4:
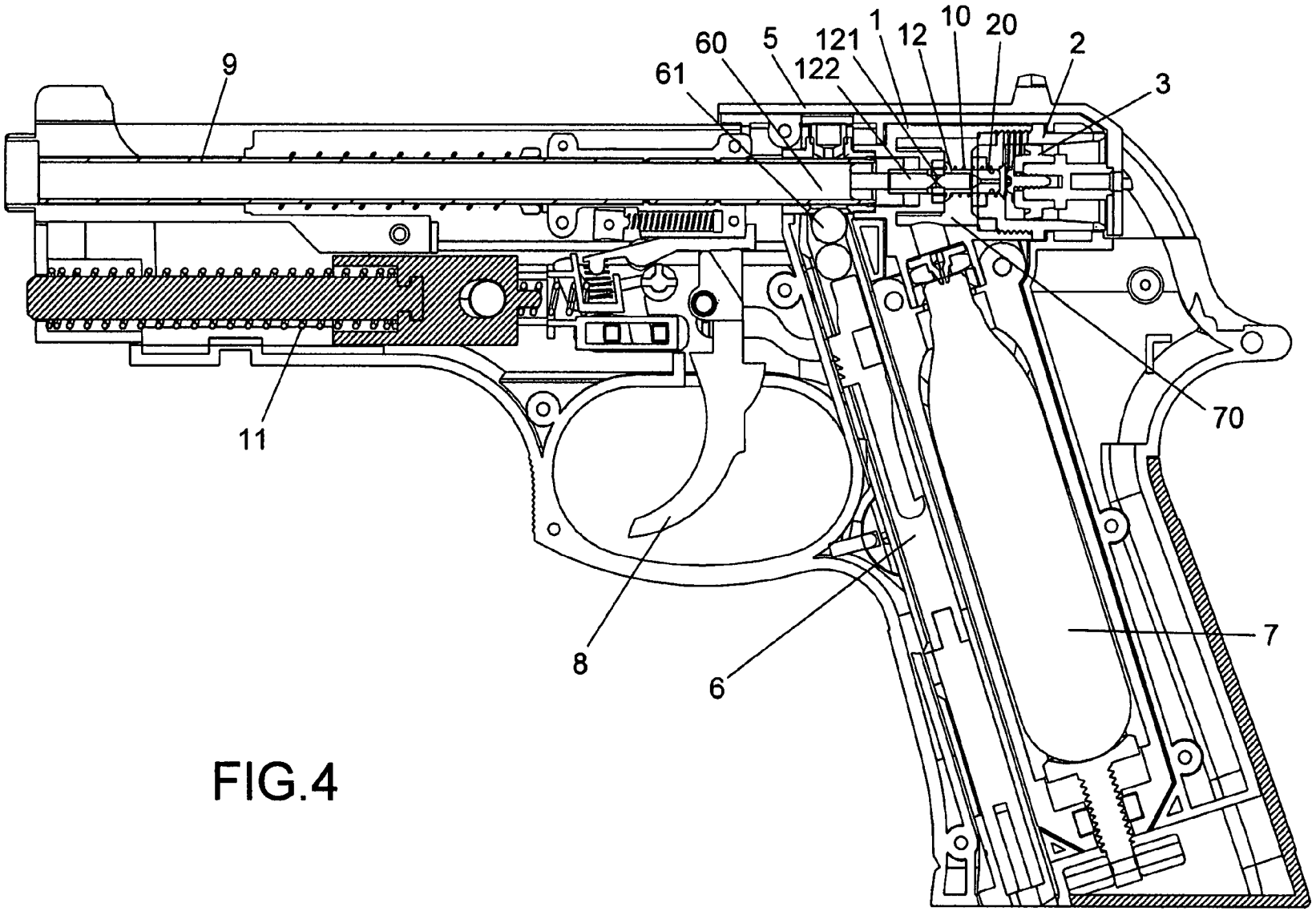
FIG. 4 is a sectional side view of the first embodiment of the present invention of the present invention, showing the continuous firing type trigger structure returned to the former position after firing of a bullet.

Referring to FIGS. 1~4, when pressed the trigger 8 of the toy gun, the gun barrel 9 is forced to move the gas outlet valve tube 12 backwards instantly, opening the passage between the inside space of the valve body 1 and the air inlet 121 of the gas outlet valve tube 12. At this time, a high pressure gas is discharged out of the high-pressure gas can 7 through the air outlet nozzle 70 of the high-pressure gas can 7 into the valve body 1. The discharged jet of high pressure gas immediately goes from the air inlet 121 of the gas outlet valve tube 12 through the air passage 122 to force one airsoft bullet 61 out of the gun barrel 9 of the toy gun. At the same time, a part of the discharged jet of high pressure gas goes to the gap between the axial through hole 20 of the valve body 1 and the gas outlet valve tube 12 to force the piston 3 and the sliding shell 5 backwards, causing the sliding shell 5 to pull the return spring 11. Immediate after firing of one airsoft bullet 61, the return spring 11 returns the piston 3 and the sliding shell 5.

Referring to FIGS. 5~9, the user can bias the hammer 4 backwards to position the hammer 4 in the released position where the retaining flange 42 is kept in positive engagement with the spring-supported sear 41, thereafter press the trigger 8 to release the spring-supported sear 41 from the retaining flange 42 of the hammer 4, causing the face 40 of the hammer 4 to strike the pin 30 of the piston 3, and therefore the pin 30 is forced to move the gas outlet valve tube 12 forwards. At this time, a high pressure gas is discharged out of the high-pressure pressure gas can gas can 7 through the air outlet nozzle 70 of the high-pressure gas can 7 into the valve body 1. The discharged jet of high pressure gas immediately goes from the air inlet 121 of the gas outlet valve tube 12 through the air passage 122 to force one airsoft bullet 61 out of the gun barrel 9 of the toy gun. At the same time, a part of the discharged jet of high pressure gas goes to the gap between the axial through hole 20 of the valve body 1 and the gas outlet valve tube 12 to force the piston 3 and the sliding shell 5 backwards, causing the sliding shell 5 to pull the return spring 11.

Although a particular embodiment of the invention has been described in detail for purposes of illustration, various modifications and enhancements may be made without departing from the spirit and scope of the invention.

What the invention claimed is:

1. A continuous firing trigger structure mechanism used in a toy gun and controllable by a trigger of the toy gun to drive airsoft bullets out of a sliding gun barrel of the toy gun, comprising:

a valve body, an enclosed socket, a piston inserted into the enclosed socket, a sliding shell affixed to the piston, a return spring arranged to return the piston and sliding shell, a trigger, and a sliding gun barrel, wherein said valve body is disposed behind an output port of a magazine clip mounted in said toy gun in air communication with an air outlet nozzle of a high-pressure gas can mounted in said toy gun, and wherein said valve body comprises a rear end axially connected with said enclosed socket, and an axial through hole extending through front and rear ends thereof, and wherein a gas outlet valve tube is inserted through the axial through hole of said valve body so as to be movable backwards by the sliding gun barrel of said toy gun upon actuation of the trigger, said gas outlet valve tube having an air inlet and an air passage, and a spring mounted thereon to support said gas outlet valve tube in a position where the air inlet of said gas outlet valve tube is isolated from an inside space of said valve body; wherein, upon actuation of the trigger, a first portion of the high-pressure gas is directed to go from the air inlet of the gas outlet valve tube through the air passage to force a bullet out of the sliding barrel and wherein a second portion of the high-pressure gas goes to a gas between the axial through hole of the valve body and the gas outlet valve tube so as to force the piston and the sliding shell backwards, thereby causing the sliding shell to pull the return spring.

* * * * *